United States Patent [19]

Grover

[11] 4,360,350

[45] Nov. 23, 1982

[54] HOLLOW KEEL HEAT EXCHANGER FOR MARINE VESSELS

[76] Inventor: Albert D. Grover, 94 S. Long Beach Ave., Freeport, Nebr.W YORK 11520

[21] Appl. No.: 158,539

[22] Filed: Jun. 11, 1980

[51] Int. Cl.[3] ..... B61D 27/00

[52] U.S. Cl. ..... 440/88; 114/140

[58] Field of Search ..... 440/88, 38, 46; 114/140, 142, 289, 288, 290, 126

[56] References Cited

U.S. PATENT DOCUMENTS

| | | | |
|---|---|---|---|
| 2,382,218 | 8/1945 | Fernstrum | 440/88 |
| 2,387,700 | 10/1945 | Cribb | 440/88 |
| 3,835,492 | 9/1974 | Orchowski | 114/126 |

OTHER PUBLICATIONS

*The Complete Boating Encyclopedia,* edited by Morris Weeks, Jr., 1964, Golden Press, New York, p. 313.

*Primary Examiner*—Edward R. Kazenske
*Assistant Examiner*—Stephen P. Avila
*Attorney, Agent, or Firm*—Felfe & Lynch

[57] ABSTRACT

A marine vessel having a hull with a hollow keel, generally of a non-metallic material, and an engine cooled by a closed-loop, fresh water circulating cooling system. The keel is formed as a hollow keel chamber which has entry and exit apertures for circulating sea water through the chamber. A portion of the fresh water cooling system passes through the hollow keel chamber in heat exchange relation to the sea water providing a simple and efficient heat exchanger for cooling the engine.

6 Claims, 4 Drawing Figures

DL 5429 F
10
20
22
26
24
14
13
16
18
19
17
12
2
3
18'

HOLLOW KEEL HEAT EXCHANGER FOR MARINE VESSELS

BACKGROUND

This invention relates to a hollow keel heat exchanger for marine craft. More particularly, this invention relates to a marine vessel having a non-metallic hull and a self-contained and protected sea water heat exchanger.

Marine craft driven by internal combustion engines require cooling systems for the engine. Sea water has been used for this purpose as described by Morgan in U.S. Pat. Nos. 968,385 and Barlow et al in 1,099,684, but there are serious drawbacks to this because of the corrosive nature of sea water.

To prevent corrosive attack in the engine interior, marine engines have been equipped with closed-loop, fresh water circulating cooling systems which are cooled by a sea water heat exchanger generally having its own pump for circulating sea water through the heat exchanger. It has been proposed to locate a portion of the fresh water loop on the exterior of the hull but the possibility for damage or destruction is great if the craft runs aground or strikes a submerged article. U.S. Pat. Nos. 2,258,526 to Walter, 2,382,218 to Fernstrum, 2,682,852 to Ruffolo, 2,612,858 to Mairs, are typical of cooling pipes outside the protection of the hull.

It has also been proposed to circulate the fresh water in direct contact with a submerged portion of the hull. However, this requires that the hull be made of a material of high thermal conductivity such as metal (see for example U.S. Pat. Nos. 2,387,700 to Cribb and 2,976,834 to Waldron et al) and is not feasible with materials of low thermal conductivity such as wood or fiber reinforced plastics now widely used in boat building.

The present invention overcomes the drawbacks to prior proposals and provides a simple, efficient and protected heat exchanger especially for marine craft with non-metallic hulls.

SUMMARY

The present invention provides a marine propulsion system and a marine vessel having preferably a non-metallic hull with a hollow keel and a propulsion means cooled by closed-loop, fresh water circulating cooling means. The hollow keel is formed as a chamber which is closed to the hull interior and is provided with entry means, preferably apertures along the sides of the keel, and exit means, preferably one or more apertures at the rear end of the keel. The entry and exit means allow circulation of sea water through the keel chamber. A portion of the fresh water cooling means passes through the keel chamber in heat exchange relation to the sea water circulating therethrough. It is preferred that the propulsion means include a submerged prop positioned aft of the keel such that sea water circulation through the keel chamber is aided by rotation of the prop.

DESCRIPTION OF THE DRAWINGS

The present invention will be more fully understood from the following description taken in conjunction with the accompanying drawings wherein.

DESCRIPTION

Figures 1, 2, 3, 4:
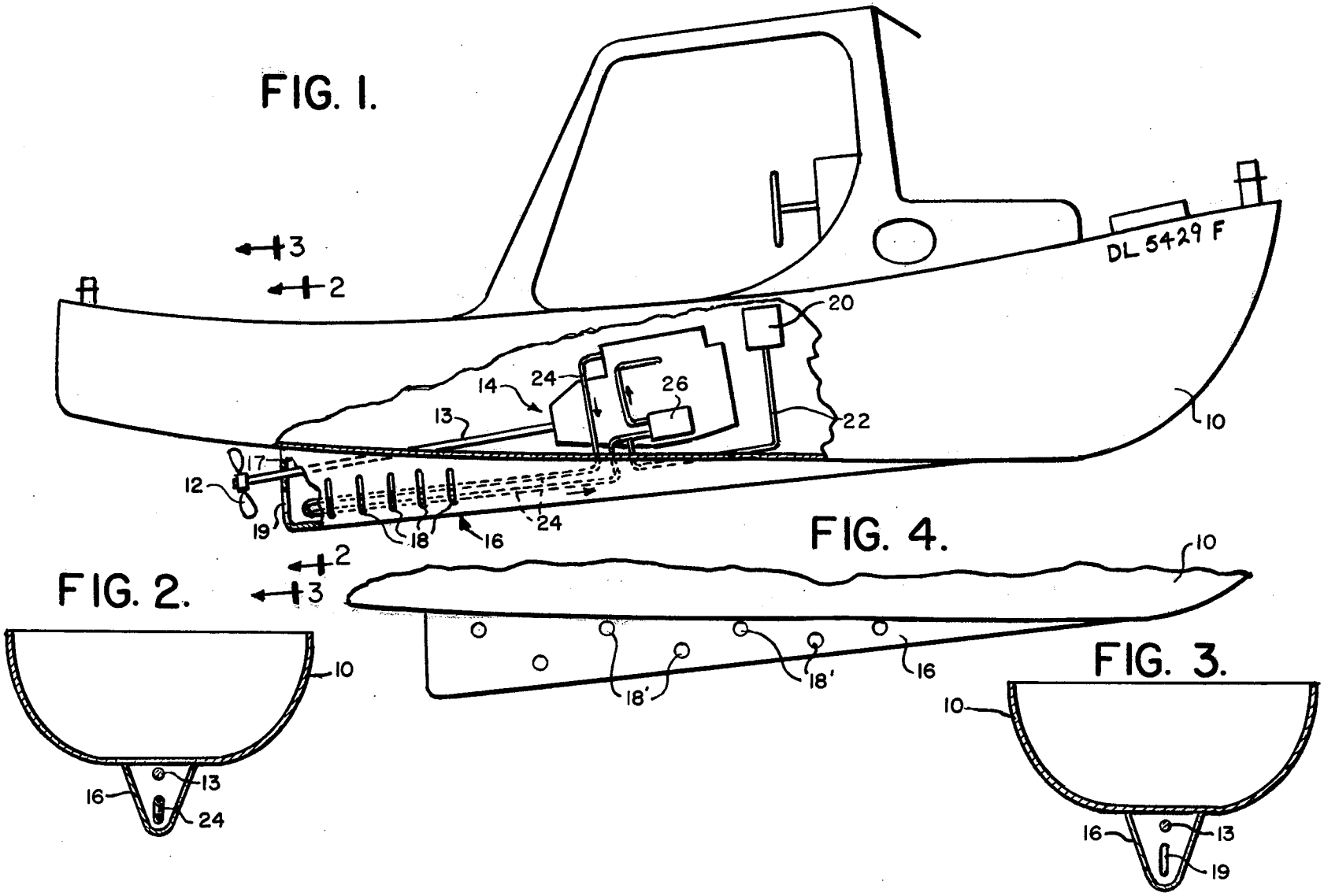
FIG. 1 is a diagrammatic side view partly in cross-section of a marine vessel having a hollow keel heat exchanger in accordance with the invention.
FIG. 2 is a sectional view taken along line 2—2 of FIG. 1.
FIG. 3 is a sectional view taken along line 3—3 of FIG. 1.
FIG. 4 is a side view partially broken away of a modified hollow keel heat exchanger according to the invention.

The marine craft and propulsion system of the invention includes a hull 10 which is preferably made of a non-metallic material of construction such as glass fiber reinforced plastic such as polyester or aramid fiber reinforced plastic. The hull 10 is provided with a hollow keel 16 having a blunt aft end 17. The craft is driven by a propulsion system indicated generally by reference numeral 14 which can be, for example, a gasoline or diesel powered inboard engine which drives prop 12 aft of the hollow keel 16 via shaft 13.

The engine 14 is provided with a closed-loop, fresh water circulating cooling means comprising a circulation pump 26, line 24 leading from the cooling manifold to the circulation pump, line 28 leading from the circulation pump to the cooling manifold and an expansion tank 20 which is connected to line 24 via line 22.

Hollow keel 16 has entry apertures such as slots 18 shown in FIG. 1 or holes 18' shown in FIG. 4, which preferably are located along the sides of the hollow keel 16. An exit aperture 19 is preferably located in the aft end 17 of the hollow keel 16.

A portion of the line 24 passes through the hollow keel chamber 16 in heat exchange relation to sea water circulating therethrough via apertures 18 and 19. The amount of cooling in the hollow keel 16 can be regulated by the amount of line 24 which passes therethrough. Rather than the single return path as shown in FIG. 1, line 24 can form a helical coil or it can wind back and forth within the confines of the hollow keel 16.

The rotation of the prop 12 aids circulation of sea water through the keel chamber 16 in heat exchange relation with line 24. The number and configuration of the entry apertures 18 can be regulated in relation to the size of the exit aperture 19 in the aft end of the keel 16 to increase, maximize or decrease the flow of sea water through the hollow keel.

The hollow keel 16 provides for efficient and simple heat exchange means for the fresh water cooling loop for the engine 14. The line 24 is completely protected by the hollow keel 16. Depending on engine size and cooling requirements, a circulating pump can be positioned within the hollow keel 16 to promote the flow of sea water therethrough but generally the heat exchange device of the invention will function without the need of such a pump thereby eliminating one piece of equipment generally required in a fresh water cooling system for a marine craft.

What is claimed is:

1. In a marine vessel having a hull with a downwardly projecting closed hollow keel and propulsion means cooled by closed loop, fresh water circulating cooling means, the improvement which comprises:

means sealing said hollow keel from the hull interior to form a keel chamber;

means providing for the circulation of sea water through the keel chamber when the vessel is moving through the water comprising inlet apertures in at least one side of the keel and at least one outlet aperture in the rear end of the keel; and wherein the cooling means includes heat exchange means disposed in said keel chamber and operative with the sea water circulating therethrough to effect heat exchange and thereby cool the fresh water in the cooling means.

2. The vessel of claim 1, wherein the propulsion means includes a submerged prop positioned aft of the keel to enhance sea water circulation through the keel chamber in response to the rotation thereof.

3. The vessel of claim 1, wherein the hull and keel comprise nonmetallic material.

4. In a marine propulsion system having a closed-loop, fresh water circulating cooling means for use in a vessel having a hull with a downwardly projecting closed hollow keel, the improvement comprising means for cooling the fresh water with sea water including means sealing the hollow keel from the hull interior to form a keel chamber, means providing for the circulation of sea water through the keel chamber when the vessel is moving through the water comprising inlet apertures in at least one side of the keel and at least one outlet aperture in the rear end of the keel, and wherein the cooling means includes heat exchange means disposed in the keel chamber and operative with the sea water circulating therethrough to effect heat exchange and thereby cool the fresh water in the cooling means.

5. The system of claim 4 further comprising a submerged prop positioned aft of the keel to enhance sea water circulation through the keel chamber in respose to the rotation thereof.

6. The system of claim 4, wherein the hull and keel comprise nonmetallic material.

* * * * *